United States Patent [19]

Eidson, II

[11] Patent Number: 5,018,449

[45] Date of Patent: May 28, 1991

[54] PAINT DISPERSING TRAINING GRENADE

[76] Inventor: Edward W. Eidson, II, 375 Caspian Way, #4, Imperial Beach, Calif. 92032

[21] Appl. No.: 246,775

[22] Filed: Sep. 20, 1988

[51] Int. Cl.[5] ..... F42B 8/12

[52] U.S. Cl. ..... 102/498; 102/248; 102/276; 102/513; 273/418; 222/79; 446/401

[58] Field of Search ..... 273/418; 446/401; 222/5, 23, 79, 80, 402.11; 102/248, 257, 268, 276, 395, 445, 502, 529, 482, 486, 487, 488, 498, 513, 334, 368–370

[56] References Cited

U.S. PATENT DOCUMENTS

| | | | |
|---|---|---|---|
| 1,563,176 | 11/1925 | Eimer | 102/334 |
| 1,709,636 | 4/1929 | Snelling . | |
| 2,051,331 | 8/1936 | DeBobula | 102/487 |
| 2,897,630 | 8/1959 | Horowitz et al. . | |
| 3,139,697 | 7/1964 | Mier . | |
| 3,225,490 | 12/1965 | Ostrom | 446/401 |
| 3,369,486 | 2/1968 | Wrennstad et al. . | |
| 3,399,468 | 9/1968 | Gahle . | |
| 3,419,274 | 12/1968 | Taber | 273/418 |
| 3,492,945 | 2/1970 | Filippi | 102/498 |
| 3,564,756 | 2/1971 | Yokoi . | |
| 3,695,246 | 10/1972 | Filippi et al. . | |
| 3,878,639 | 4/1975 | Schular et al. . | |
| 4,392,432 | 7/1983 | Fenrick et al. | 102/334 |

FOREIGN PATENT DOCUMENTS

| | | | |
|---|---|---|---|
| 587310 | 11/1959 | Canada | 102/482 |
| 2020482 | 7/1970 | France | 102/482 |
| 102639 | 12/1916 | United Kingdom | 102/487 |
| 1263522 | 2/1972 | United Kingdom | 102/513 |
| 117734 | 8/1981 | United Kingdom | 102/487 |

*Primary Examiner*—Harold J. Tudor

*Attorney, Agent, or Firm*—Litman, McMahon & Brown

[57] ABSTRACT

A paint dispersing training grenade includes a grenade body having dispersing passages extending between a central bore and an external surface of the grenade body, a plug threadedly received in one end of the bore, a piston resiliently urged by a spring toward the plug, a rupturable colorant containing capsule positioned between the piston and the plug, a separable release lever releasably pivotal on the grenade body and engaged with an abutment disk on a shaft extending from the piston, and an inertial delay mechanism engaged between the grenade body and the piston. The delay mechanism includes pivotable delay levers engaged with the piston at one end and having wheels rollably engaging a surface of the grenade body at another end. When the release lever is separated, movement of the piston by the spring is resisted by startup inertia of the wheels in rotating. When the inertia is overcome, the piston forceably ruptures the capsule and propels the colorant out of the grenade body through the dispersion passages.

11 Claims, 2 Drawing Sheets

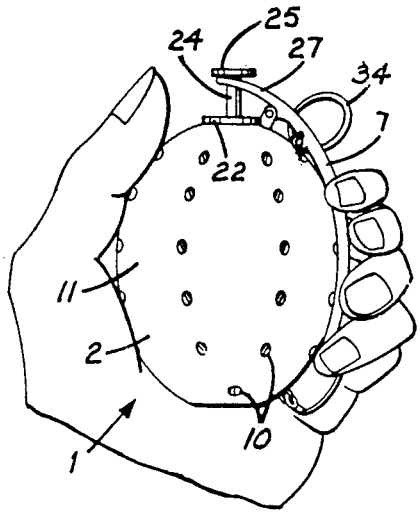
Fig. 1.
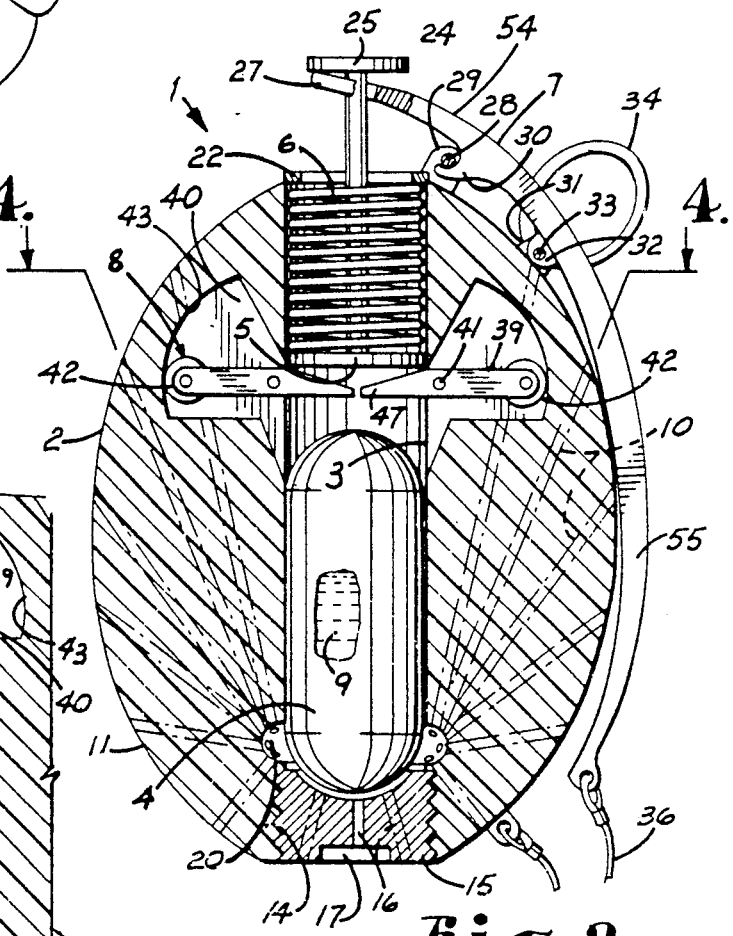
Fig. 2.
Fig. 3.
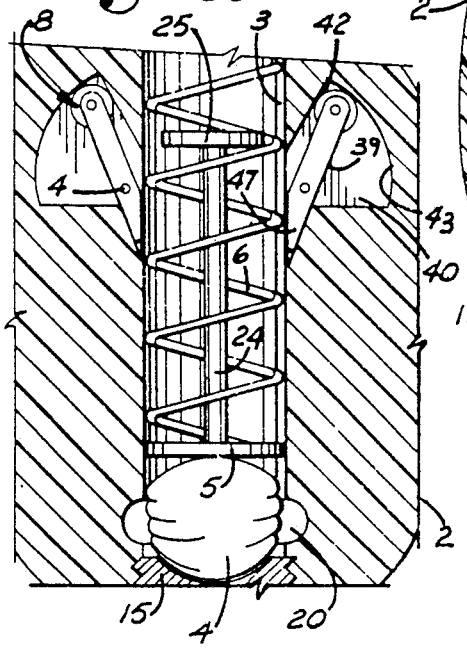

PAINT DISPERSING TRAINING GRENADE

FIELD OF THE INVENTION

The present invention relates to practice or training weapons and, more particularly, to a practice grenade which forcefully disperses a colored liquid marking medium by the action of a spring driven piston and which includes an inertial delay mechanism.

BACKGROUND OF THE INVENTION

In the past, war games in military training were often judged or scored by umpires based on troop strength and tactical position and statistical analysis thereof. More currently, special training weapons are often employed in such training to sharpen combat skills and to provide a mechanism for objectively scoring proficiency in such skills. For example, rifles having the look and feel of currently employed combat rifles are fitted with laser emitters, and combatants wear laser receivers which record a "kill" when a laser signal is received. Such an arrangement develops the aiming skill of the shooter while providing an objective indication of a "casualty".

In recent years, a combat type sport has developed in which the principal equipment or weapon is a gun which shoots paintballs. The propellant in the gun is compressed air or carbon dioxide cartridges. The paintballs are substantially spherical capsules, often formed of pharmaceutical capsule type gelatin, filled with a washable, pigmented liquid, resembling latex type paint in some respects. Currently, the principal participants are civilians grouped in teams who execute strategies and tactics, according to established rules, in competition with an opposing team. If a player is shot by a paintball, the player is considered a casualty and is unable to further assist his team. Because of the bright colors of the paints used and the difficulty of removing the results of a hit in the field, scoring of hits or casualties can be accomplished objectively.

In the area of anti-personnel weapons, such as grenades, mines, and the like, it has generally been difficult to devise safe simulation devices with which casualties can be objectively scored. Generally, devices which emit a loud report and/or smoke are employed, and scoring is done on a basis of survival statistics within a given radius of the weapon simulated.

At least one toy grenade is known which disperses a dye liquid upon detonation. The grenade body is filled with the dye liquid and compressed air and has a valve controlling flow of the liquid to dispersion orifices. The valve is controlled by a trigger mechanism which extends from the lower end of the grenade when armed. The grenade body is weighted so that, at least theoretically, when the grenade is thrown, it lands on the lower end and actuates the trigger. One inherent problem with this grenade is that the liquid releasing valve is at the top of the liquid chamber such that if the grenade lands as intended, when the valve opens, the compressed air escapes first and is unavailable for propelling a major portion of the liquid. And unless the grenade lands lower side down, actuation of the trigger mechanism is not assured.

SUMMARY OF THE INVENTION

The present invention provides a liquid dispersing training grenade in which the propelling force is provided by a compressed spring which drives a piston to forcefully rupture a pellet containing a pigmented liquid or paint. Passages extend in universal directions from an end of a central bore in which the paint pellet is located. The piston is initially held by a release lever releasably pivoted on the grenade body. A delay mechanism is provided which temporarily prevents movement of the piston when the release lever is disconnected from the grenade body and separated.

The delay mechansim includes a plurality of delay levers pivoted within the grenade body and engaging the piston. The ends of the delay levers have delay wheels mounted thereon which engage tracks within the grenade body. The delay wheels are configured to have substantial angular inertia which must be overcome to initiate rotation thereof. The delay levers have fulcrum pivots positioned to multiply the inertial resistance force of the delay wheels back to the piston. The delay levers are also configured such that they must be pivoted to a certain angle before the piston can slide by them. The delay wheels are preferably pinion gears meshed with rack gears within the grenade body.

OBJECTS OF THE INVENTION

The principal objects of the present invention are: to provide an improved training grenade type device; to provide such a grenade which is non-pyrotechnic and non-lethal; to provide such a grenade which gives a clear indication of "hits" for military type training; to provide such a grenade which forcefully disperses a charge of a pigmented colorant or paint upon "detonation"; to provide such a grenade wherein the colorant is inert, non-poluting, and washable; to provide such a grenade wherein the colorant is contained within a rupturable and replaceable pellet; to provide such a grenade wherein the mechanism for releasing the colorant includes a piston driven by a compressed spring; to provide such a grenade including a pinned release lever which safely maintains the spring in a compressed state and which is used as a lever to facilitate the final stage of compressing the spring; to provide such a grenade wherein the release lever reliably releases the piston to crush the colorant pellet; to provide such a grenade including a delay mechanism to provide a short delay between separation of the release lever and actual release of the piston to allow the grenade to be thrown before dispersion of the colorant occurs; to provide such a grenade wherein the delay mechanism exploits the startup angular momentum of friction wheels or gears in cooperation with lever arms to provide the delay; to provide such a grenade which can be conveniently disassembled, washed, and reloaded for reuse; and to provide such a training paint grenade which is economical to manufacture, reliable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a side elevational view of a paint dispersing training grenade embodying the present invention.

FIG. 2 is an enlarged cross sectional view illustrating a paint pellet, a spring driven pellet rupturing piston, and an inertial delay mechanism of the grenade.

FIG. 3 is a fragmentary view similar to FIG. 2 and shows the piston in an extended position and the pellet collapsed.

DETAILED DESCRIPTION OF THE INVENTION

Figure 4:
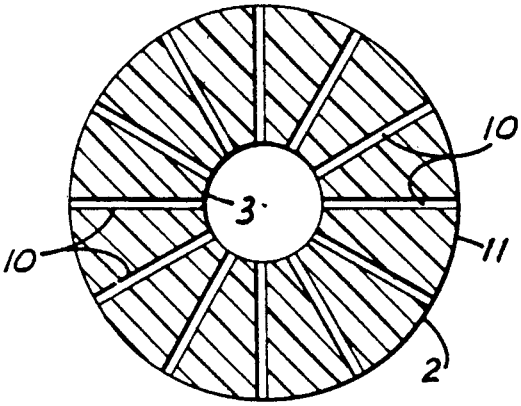
FIG. 4 is a conical sectional plan view taken at a reduced scale on a surface described by lines 4—4 of FIG. 2 and illustrates a pattern of paint dispersion passages of the grenade.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a paint dispersing training grenade according to the present invention. The grenade 1 generally includes a grenade body 2 having a central cavity or bore 3 with a paint pellet 4 positioned therein, a pellet crushing piston 5 positioned in the bore 3 and urged toward the pellet 4 by a cOmpressed spring 6, a release lever 7 attached to the grenade body 2 and engaging an upper end of the piston 5 to prevent it from moving, and a delay mechanism 8 engaged between the grenade body 2 and the piston 5. Upon separation of the release lever 7 from the grenade body 2 and piston 5, the spring 6 urges the piston 5 against the delay mechanism 8 which, after a short delay, pivots out of the way of the piston 5. Thereafter, the piston 5 is driven against the pellet 4, rupturing same, and propelling a colorant or paint 9 therein out of the grenade body 2 through dispersion passages 10 communicating between the bore 3 and an external surface 11 of the grenade 1.

The grenade body 2 may be formed in any practical shape such as spherical, cylindrical, stepped cylindrical, or ovoid, i. e. egg-shaped, as is illustrated. Preferably, the grenade body 2 is shaped and balanced similar to the actual weapon it is intended to simulate, especially for military training purposes. The grenade body 2 is preferably formed of a high strength and durability plastic material. It may be formed in halves (not shown), for more convenient manufacture and access to the interior for cleaning and repair, and assembled by suitable fasteners (not shown).

The bore 3 extends centrally through the grenade body 2. A lower end of the bore 3 has internal threads 14 to receive a plug 15 against which the pellet 4 will be crushed. The plug 15 has dispersion passages 16 formed therethrough. A slot 17 may be formed in a lower surface of the plug 15 to receive a screwdriver or coin to facilitate installation and removal of the plug 15. The removable plug 15 is provided for access to the bore 3 to facilitate re-arming or resetting the grenade 1 and for cleanup thereof and replacement of pellet 4 after use. Immediately above the threads 14, a circumferential paint distribution channel 20 is formed which communicates with the paint dispersion passages 10.

At the opposite end of the bore 3 from the plug 15, an annular shoulder is formed by a ring 22 attached to the grenade body 2. The spring 6 bears against the ring 22 when it is compressed. The spring 6 is a helical compression spring and resiliently engages the piston 5 to urge it against the paint pellet 4. The piston 5 has a piston shaft 24 extending thereabove which terminates in a disk shaped abutment 25 which is engaged by the release lever 7 to resist the force of the spring 6 until simulated detonation of the grenade 1 is desired. The abutment 25 has a smaller diameter than the inner diameters of either the ring 22 or the spring 6 in order to pass easily therethrough.

The release lever 7 is curved to roughly conform to the external surface 11 of the grenade body 2 and has a forked upper end 27 to straddle the piston shaft 24. The lever 7 is perferably formed of metal to avoid being bent. The release lever 7 must be connected to the grenade body 2 in at least two places to prevent it from being pivoted by the force of the spring 6. A release lever pivot pin 28 is mounted in a pair of ears 29. The release lever 7 is provided with a pivot hook 30 which forms a partial pivot for the release lever. Since the hook 30 is open toward the upper end 27 of the release lever 7, pivoting of the release lever through a small angle causes the lever 7 to be released from the grenade assembly to prevent the upper end 27 from blocking movement of the piston abutment 25. A second connection point for the release lever 7 is provided by cooperating tabs 31 and 32 positioned respectively on the grenade body 2 and the release lever 7 and an arming pin 33 which preferably includes a ring 34 to facilitate gripping. The illustrated grenade 1 includes a lanyard 36, which may be elastic, attaching the release lever 7 to the grenade body 2 to prevent loss of the release lever.

The illustrated pellet or colorant container 4 is substantially cylindrical with hemispherical ends and is sized to fit within the bore 3 with a small clearance between it and the surface of the bore 3. The pellet 4 may be formed of any material which is durable in storage and which will not be softened by interaction with the colorant or paint 9 but which will easily rupture under the pressure of the piston 5. The material forming the pellet 4 may be pharmaceutical capsule type gelatin, a suitable plastic, or the like. The colorant 9 is preferably a pigmented, low viscosity liquid which will not react with the pellet material. Low viscosity is desirable to facilitate propulsion of the colorant 9 through the dispersion passages 10. The colorant or paint 9 is preferably pigmented densely enough for good visibility without appreciably increasing the viscosity thereof. Bright colors, such as yellow, orange, white, and the like, are preferred for high visibility. The paint 9 is formulated to be washable to avoid permanent staining of uniforms and components of the grenade 1, to be nonpolluting, and to be noninjurious, nontoxic, and nonirritating. Even so, it is recommended that eye protection, such as goggles, be worn during use of the grenade 1 to avoid possible eye injury from the colorant 9 travelling at high velocities upon detonation of the grenade. An alternative to the illustrated pellet 4 and colorant 9 is a pellet employing two compartments (not shown) for containing two liquids, one containing a pigment or dye, which are mixed when the pellet is crushed to form an effervescent liquid to provide an additional propulsive force to the colorant from the grenade 1.

Figure 5:
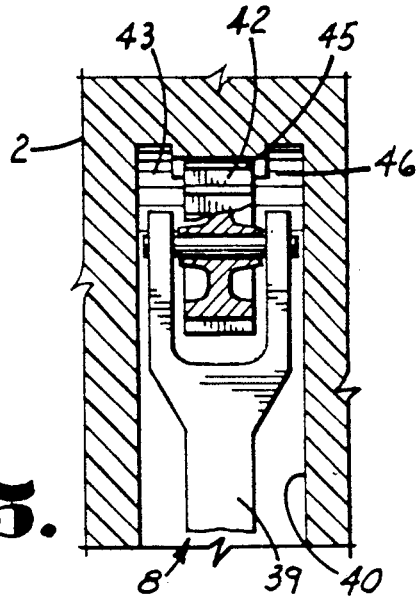
FIG. 5 is an enlarged fragmentary sectional view of a modified delay component of the grenade incorporating a rack and pinion.
Figure 6:
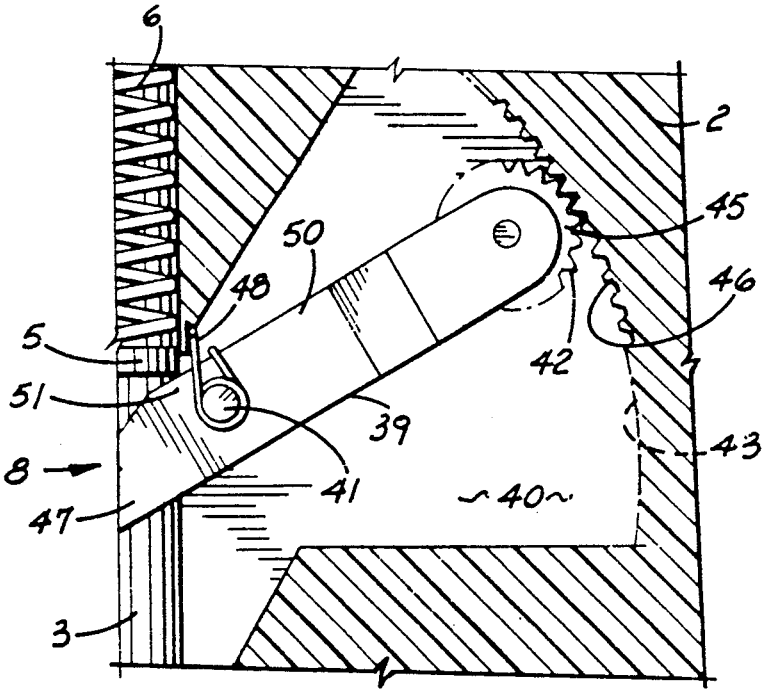
FIG. 6 is an enlarged fragmentary cross sectional view similar to FIG. 2 and illustrates further details of the modified delay mechanism of the grenade of the present invention.

The delay mechanism 8 may be any type of mechanism which provides a short delay between release of the release lever 7 and rupture of the pellet 4, to allow time for the grenade 1 to be thrown before bursting of the pellet occurs. The illustrated delay mechanism 8 includes a pair of delay levers 39 pivotally mounted in sector shaped cavities 40 formed within the grenade body 2 by delay pivots 41 and positioned for engagement by the piston 5 to block same. Outer ends of the levers 39 have delay wheels 42 rotatably mounted thereon which rollingly engage a surface 43 within the cavities 40. In FIGS. 2 and 3, the wheels 42 frictionally engage the surface 43 while FIGS. 5 and 6 show one of the wheels 42 as a pinion 45 meshed with a curved rack gear 46 formed or positioned on the surface 43 of the cavity 40. Outer ends 47 of the delay levers 39 are angled off or ramp shaped such that the delay levers must be pivoted to a selected angle before the piston 5 is cleared to move by the delay levers (see FIG. 3). The delay levers 39 are urged toward their blocking positions by delay lever orienting torsion springs 48 (FIG. 6) to avoid movement of the delay mechanisms 8 to their nonblocking positions by gravity if the grenade 1 has been in an inverted orientation prior to use.

The illustrated delay mechanism 8 exploits the angular momentum of the wheels 42 to provide the delay. The rotational startup inertia of the wheels 42 must be overcome by the force of the spring 6 in order to pivot the delay levers 39 out of the way of the piston 5. The force of resistance to pivoting of the delay levers 39 provided by the delay wheels 42 is multiplied by the ratio of the moment arms of the portions of the delay levers on opposite sides of the pivots 41. Referring to FIG. 6, a wheel lever arm 50 extending between the pivot 41 and the point of contact of the wheel 42 with the surface 43 is considerably longer than a piston lever arm 51 extending between the pivot 41 and the point of contact of the piston 5 with the delay lever 39. The spring constant of the delay lever orienting spring 48 contributes a negligible amount of resistance to pivoting of the delay lever 39 because its moment arm is comparable to that of the piston lever arm 51. Although the resistance force developed by the rotational startup inertia of the wheels 42 is small compared to the force of the spring 6, overcoming the resistance force to pivot the delay levers 39 to a release angle requires a finite amount of time.

A sufficient number of passages 10 and 16 are formed in the grenade 1 and plug 15 to provide for dispersion of the colorant 9 in universal directions from the grenade 1. As illustrated in FIGS. 1, 2, and 4, the passages 10 in the grenade body 2 are arranged in conical layers. Different layers may have different numbers of passages 10 according to the transverse diameter of the grenade body 2 at a given level. FIG. 4 illustrates twelve passages 10 extending radially from the central bore 3; however, a greater or lesser number of passages 10 may be provided, according to the propelling force available from the spring 6 employed, the diameter of the passages 10, and the viscosity of the colorant 9. Preferably, the passages 10 have a diameter which is inversely related to their length for equivalent flow resistance among the passages 10 so that the colorant 9 is dispersed with approximately uniform velocity in all directions.

The grenade 1 is set for operation by removing the plug 15, pivoting the delay levers 39 out of the bore 3, placing the spring 6 in the bore, and placing the piston 5 in the bore by extending the abutment disk 25 through the spring 6. The piston 5 is urged against the spring to extend the abutment disk 25 clear of the bore 3. The outer end 27 of the release lever is inserted under the abutment disk 25, and the hook 30 of the release lever is engaged with the pivot pin 28. The release lever 7 is employed to urge the piston assembly to its final position past the delay levers 39. A piston lever arm 54 of the release lever 7, extending between the pivot hook 30 and the point of contact between the end 27 and the abutment disk 25, is shorter than an opposite hand lever arm 25 of the release lever. The leverage provided by this relationship facilitates the final positioning of the piston assembly. The release lever 7 is then fixed in place by insertion of the release pin 33 through the tabs 31 and 32. A capsule 4 is inserted in the bore 3, and the plug 15 is replaced to complete the operational assembly of the grenade 1.

When the grenade 1 is to be used, it is held with the hand gripping the grenade body 2 and the release lever 7, and the ring 34 is grasped to remove the pin 33. When the grenade 1 is thrown, the release lever 7 separates from the grenade body 2 thereby disengaging the end 27 from the abutment disk 25. The spring 6 then urges the piston 5 toward the pellet 4 against the resistance created by the angular inertia of the wheels 42 of the delay mechanisms 8. When this inertia has been overcome, the piston 5 is driven forcefully against the pellet 4, rupturing it and forcing the colorant 9 toward the distribution channel 20 and, from there, out of the grenade body 2 through the dispersion passages 10. Because the dispersion passages 10 extend in approximately universal directions, successful dispersion of the colorant 9 is not dependent upon the orientation of the grenade 1 when it lands on the ground. Any opposing combatants marked by the colorant 9 are clearly discernible as casualties.

After use of the grenade 1, it may be cleaned by removal of the plug 15 and the other internal parts and immersion in water. Rearming of the grenade 1 may then be accomplished by the same steps as in the initial assembly described above.

While the present invention has been described and illustrated by the embodiment of the grenade 1, the arrangements of the components of the present invention are also applicable to other types of simulated weapons, such as paint dispersing "anti-personnel" mines and the like. Therefore, such other embodiments are intended to be encompassed within the spirit of the present invention.

It is to be understood that while certain forms of the present invention have been illustrated and described herein, it is not to be limited to the specific forms or arrangement of parts described and shown.

What is claimed and desired to be secured by Letters Patent is as follows:

1. A training weapon comprising:

(a) a weapon body having a cavity therein and a plurality of dispersion passages communicating between said cavity and an external surface of said body;

(b) a rupturable colorant container positioned in said cavity, being filled with a colorant, and releasing said colorant upon being ruptured;

(c) colorant container crusher means positioned within said weapon body and being urged toward said colorant container;

(d) crusher release means engaged between said crusher means and said weapon body; said release means normally maintaining said crusher means out of engagement with said colorant container and, upon being released, freezing said crusher means to rupture said colorant container to release said colorant and force said colorant out of said weapon body through said dispersion passages;

(e) crusher delay means engaged between said crusher means and said weapon body, said delay means preventing movement of said crusher means after release of said release means for a delay period and after said delay period allowing said crusher means to rupture said colorant container to release said colorant and force said colorant out of said weapon body through said dispersion passages;

(f) said crusher delay means including inertia delay means engaged between said crusher means and said weapon body, said inertia-delay means having a startup inertia which initially resists movement of said crusher means and which is overcome by said crusher means during said delay period; and (g) said inertia delay means including:

(1) a delay lever pivotally connected to said weapon body and engaged with said crusher means;

(2) a delay wheel rotatably connected to said delay lever and rollingly engaging said weapon body; and (3) said crusher means, when released, causing said delay lever to pivot and thereby causing said delay wheel to roll along said weapon body, rolling of said delay wheel being slowed initially by angular inertia of said delay wheel.

2. A weapon as set forth in claim 1 wherein said delay lever includes:

(a) a delay lever pivot at which said delay lever is pivotally connected to said weapon body;

(b) a first delay lever arm extending between said pivot and a point of contact between said delay lever and said crusher means;

(c) a second delay lever arm extending between said pivot and a point of contact between said delay wheel and said grenade body; and (d) said first delay lever arm being substantially shorter than said second delay lever arm whereby an inertial resistance force provided by said delay wheel to said crusher means is multiplied through said delay lever.

3. A training weapon as set forth in claim 1 including:

(a) a delay rack gear positioned within said weapon body; and (b) said delay wheel being a delay pinion gear meshed with said delay rack gear.

4. A training weapon comprising:

(a) a weapon body having a cavity therein and a plurality of dispersion passages communicating between said cavity and an external surface of said body;

(b) a rupturable colorant container positioned in said cavity, being filled with a colorant, and releasing said colorant upon being ruptured;

(c) colorant container crusher means positioned within said weapon body and being urged toward said colorant container;

(d) crusher release means engaged between said crusher means and said weapon body; said release means normally maintaining said crusher means out of engagement with said colorant container and, upon being released, freeing said crusher means to rupture said colorant container to release said colorant and force said colorant out of said weapon body through said dispersion passages;

(e) crusher delay means engaged between said crusher means and said weapon body, said delay means preventing movement of said crusher means after release of said release means for a delay period and after said delay period allowing said crusher means to rupture said colorant container to release said color ant and force said colorant out of said weapon body through said dispersion passages;

(f) said crusher delay means including inertia delay means engaged between said crusher means and said weapon body, said inertia delay means having a startup inertia which initially resists movement of said crusher means and which is overcome by said crusher means during said delay period; and (g) said inertia delay means including:

(1) a plurality of delay levers pivotally connected to said weapon body and engaged with said crusher means;

(2) a plurality of delay wheels rotatably connected respectively to said delay levers and rollingly engaging said weapon body; and (3) said crusher means, when released, causing said delay levers to pivot and thereby causing said delay wheels to roll along said weapon body, rolling of said delay wheels being slowed initially by angular inertia of said delay wheels.

5. A training weapon comprising:

(a) a weapon body having a central bore therethrough and a plurality of dispersion passages communicating between said bore and an external surface of said body;

(b) a plug removably positioned in said body to close one end of said bore;

(c) colorant container crusher means positioned within said bore at an opposite end of said bore from said plug, said crusher means being resiliently urged toward said plug;

(d) a rupturable colorant container positioned in said bore between said plug and said crusher means; said container being filled with a liquid colorant and, in response to engagement by said crusher means, rupturing to release said colorant;

(e) crusher release means engaged between said crusher means and said weapon body, said release means normally maintaining said crusher means out of engagement with said colorant container;

(f) crusher delay means engaged between said crusher means and said weapon body, said delay means preventing movement of said crusher means after release of said release means for a delay period and after said delay period allowing said crusher means to rupture said colorant container to release said colorant and force said colorant out of said weapon body through said dispersion passages; and (g) said crusher delay means including:

(1) a delay lever pivotally connected to said weapon body and engaged with said crusher means;

(2) a delay wheel rotatably connected to said delay lever and rollingly engaging said weapon body; and (3) said crusher means, when released, causing said delay lever to pivot and thereby causing said delay wheel to roll along said weapon body, rolling of said delay wheel being slowed initially by angular inertia of said delay wheel.

6. A weapon as set forth in claim 5 wherein said colorant container crusher means includes;

(a) a piston slidably positioned in said bore; and (b) a compression spring engaged between said piston and said weapon body and resiliently urging said piston toward said colorant container.

7. A weapon as set forth in claim 5 wherein said delay lever includes:

(a) a delay lever pivot at which said delay lever is pivotally connected to said weapon body;

(b) a first delay lever arm extending between said pivot and a point of contact between said delay lever and said crusher means;

(c) a second delay lever arm extending between said pivot and a point of contact between said delay wheel and said grenade body; and (d) said first delay lever arm being substantially shorter than said second delay lever arm whereby an inertial resistance force provided by said delay wheel to said crusher means is multiplied through said delay lever.

8. A training weapon as set forth in claim 5 including:

(a) a delay rack gear positioned within said weapon body; and (b) said delay wheel being a delay pinion gear meshed with said delay rack gear.

9. A training weapon as set forth in claim 5 wherein said crusher delay means includes:

(a) a plurality of delay levers pivotally connected to said weapon body and engaged with said crusher means;

(b) a plurality of delay wheels rotatably connected respectively to said delay levers and rollingly engaging said weapon body; and (c) said crusher means, when released, causing said delay levers to pivot and thereby causing said delay wheels to roll along said weapon body, rolling of said delay wheels being slowed initially by angular inertia of said delay wheels.

10. A training weapon as set forth in claim 5 wherein said crusher release means includes:

(a) a release lever pivotally engaged with said weapon body by a release lever pivot, said release lever including a first release lever arm extending from said release lever pivot and engaging said crusher means and a second release lever arm extending from said release lever pivot and being releasably connected with said weapon body; and (b) said release lever pivot including a hook shaped projection extending from said release lever and engaging a release lever pivot pin positioned on said weapon body, said hook shaped projection engaging said release lever pivot pin through only a limited degree of pivoting of said release lever to thereby facilitate separation of said release lever from said weapon body upon release of said release lever therefrom.

11. A training grenade comprising:

(a) a grenade body having a central bore therethrough and a plurality of dispersion passages communicating between said bore and an external surface of said body;

(b) a plug removably positioned in said body to close one end of said bore;

(c) a piston slidably positioned in said bore in opposition to said plug;

(d) a compression spring engaged between said piston and said grenade body and resiliently urging said piston toward said plug;

(e) a rupturable colorant container positioned in said bore between said plug and said piston means; said container being filled with a liquid colorant and, in response to engagement by said piston, rupturing to release said colorant;

(f) a release lever pivotally engaged with said grenade body by a release lever pivot, said release lever including a first release lever arm extending from said release lever pivot and engaging said crusher means and a second release lever arm extending from said release lever pivot and being releasably connected with said grenade body, said release lever normally maintaining said piston out of engagement with said colorant container;

(g) a delay lever pivotally connected to said grenade body and engaged with said piston;

(h) a delay wheel rotatably connected to said delay lever and rollingly engaging said grenade body; and (i) said piston, when released, causing said delay lever to pivot and thereby causing said delay wheel to roll along said grenade body, rolling of said delay wheel being slowed initially by angular inertia of said delay wheel to prevent movement of said piston after release of said release lever for a delay period and after said delay period allowing said piston to rupture said colorant container to release said colorant and force said colorant out of said grenade body through said dispersion passages.

* * * * *